US010134288B2

(12) United States Patent
Blanchard, Jr. et al.

(10) Patent No.: US 10,134,288 B2
(45) Date of Patent: Nov. 20, 2018

(54) MONITORING AN OFFSHORE CONSTRUCTION

(71) Applicant: Fugro N.V., Leidschendam (NL)

(72) Inventors: Michael Joseph Blanchard, Jr., Leidschendam (NL); Edwin Martin Howard, Leidschendam (NL); John Darius Robideaux, Leidschendam (NL); Christopher Ray Stelly, Leidschendam (NL)

(73) Assignee: Fugro N.V. (NL)

( * ) Notice: Subject to any disclaimer, the term of this patent is extended or adjusted under 35 U.S.C. 154(b) by 0 days.

(21) Appl. No.: 15/437,683

(22) Filed: Feb. 21, 2017

(65) Prior Publication Data

US 2017/0243493 A1 Aug. 24, 2017

(30) Foreign Application Priority Data

Feb. 23, 2016 (NL) ..... 2016304

(51) Int. Cl.
*G01C 21/00* (2006.01)
*G08G 3/02* (2006.01)

(52) U.S. Cl.
CPC ..... *G08G 3/02* (2013.01)

(58) Field of Classification Search
CPC ..... B63B 21/22; B63B 43/18; B63B 21/50; B63B 35/4413; G01C 21/20; B63C 11/42; G01S 13/91; G01S 31/9307; G01S 7/066; G08G 3/00
USPC ..... 340/903, 436, 984; 701/301, 21.2, 33; 342/41, 183, 182, 147
See application file for complete search history.

(56) References Cited

U.S. PATENT DOCUMENTS

2008/0291052 A1 11/2008 Burns
2011/0156862 A1* 11/2011 Broman ..... B63C 11/42 340/984

(Continued)

FOREIGN PATENT DOCUMENTS

WO 2008031880 A2 3/2008

OTHER PUBLICATIONS

Search Report and Written Opinion; The Netherlands Application No. 2016304; dated Oct. 31, 2016.

(Continued)

*Primary Examiner* — Firmin Backer
*Assistant Examiner* — Munear Akki
(74) *Attorney, Agent, or Firm* — Polsinelli PC

(57) ABSTRACT

A monitoring system for monitoring an offshore construction is presented. The offshore construction to be monitored comprises mutually mechanically coupled marine assets. The monitoring system comprises a data storage unit, an intrusion detection service, an input device, and an update service. The data storage unit stores data specifying a spatial range of at least one warning zone pertaining to the offshore construction. The intrusion detection service is provided to detecting an intrusion of the spatial range and for issuing an alert message upon such detection. The input device receives position information for one or more of the marine assets. The update service updates the spatial range of the at least one warning zone based on the received position information. Additionally a monitoring method and a computer program product are provided.

20 Claims, 12 Drawing Sheets

(56) References Cited

U.S. PATENT DOCUMENTS

2011/0291862 A1* 12/2011 Broman ..... B63C 11/42
340/984
2015/0116496 A1* 4/2015 Ottavlano ..... B63B 21/26
348/148

OTHER PUBLICATIONS

Lin, Qingping et al.: "Virtual Tele-Operation of Underwater Robots," Proceedings of the 1997 IEEE International Conference on Robotics and Automation. Albuquerque, New Mexico; Apr. 20-25, 1997: XP000774327; ISBN: 978-0-7803-3613-1.

* cited by examiner

MONITORING AN OFFSHORE CONSTRUCTION

CROSS-REFERENCE TO RELATED APPLICATIONS

The application claims priority from Dutch Patent Application No. 2016304, filed Feb. 23, 2016, the contents of which are entirely incorporated by reference herein.

FIELD OF THE INVENTION

The present invention pertains to a system for monitoring an offshore construction. The present invention further pertains to a method for monitoring an offshore construction. The present invention still further pertains to a computer program product for causing a programmable system to execute the method.

BACKGROUND

Offshore constructions typically comprise a platform, e.g. a rig that has its position stabilized by a plurality of anchoring elements. The platform is connected with respective mooring lines to the anchoring elements. The mooring lines typically extend from a fairlead on respective corners of the platform to their respective anchoring elements on the seabed. The portion of the mooring lines in the vicinity of the platform is still close to the sea surface, but may be overlooked by passing vessels. Therewith a risk exists that these passing vessels collide with a mooring line which may result in damages to the mooring line or the vessel. Also the stability of the platform may be jeopardized by a displacement of the anchoring element due to forces acting thereon as a result of this collision. In attempting to mitigate this risk, warning zones are defined associated with the shallow parts of the mooring lines and position data of passing vessels is monitored, e.g. by a radar system. If it appears that a monitored position is inside a warning zone, an alert message is generated. Upon noticing the alert message, platform personnel can order the commander of the vessel to maneuver outside the warning zone.

In practice it occurs that the coordinates of a warning zone are incorrect. One cause is a human error in specifying the coordinates. The operator may for example inadvertently have entered erroneous information, or may have forgotten to update the information. Also erroneous coordinates of the warning zones may be the result of drift of the platform due to sea currents and the like. Errors in the coordinates entail the risk that a false alarm is given or even worse that no alarm is issued at all in case a vessel approaches a mooring line, so that a collision therewith cannot be avoided.

SUMMARY OF THE INVENTION

It is the object of the present invention to mitigate this risk. In accordance therewith a monitoring system is provided as claimed in claim 1. Additionally, a method is provided as claimed in claim 14. Furthermore, a computer program product is provided as claimed in claim 19.

A more reliable monitoring is made possible in that the operator does not need to specify the coordinates of the warning zone, but merely needs to specify its dimensions. Accurate and up to date information of the coordinates of the warning zone is maintained automatically on the basis of input data specifying coordinates of the platform and/or its associated marine assets. In this way it is prevented that collision risks are not timely signaled.

The input data specifying coordinates of the platform may comprise coordinates specifying a position of at least one anchor fairlead where an anchor mooring line is coupled to the platform. The input data specifying coordinates of its associated marine assets, may include input data specifying a position of an anchoring element.

BRIEF DESCRIPTION OF THE DRAWINGS

These and other aspects are described in more detail with reference to the drawing, therein.

DETAILED DESCRIPTION OF EMBODIMENTS

Like reference symbols in the various drawings indicate like elements unless otherwise indicated.

Figure 1:
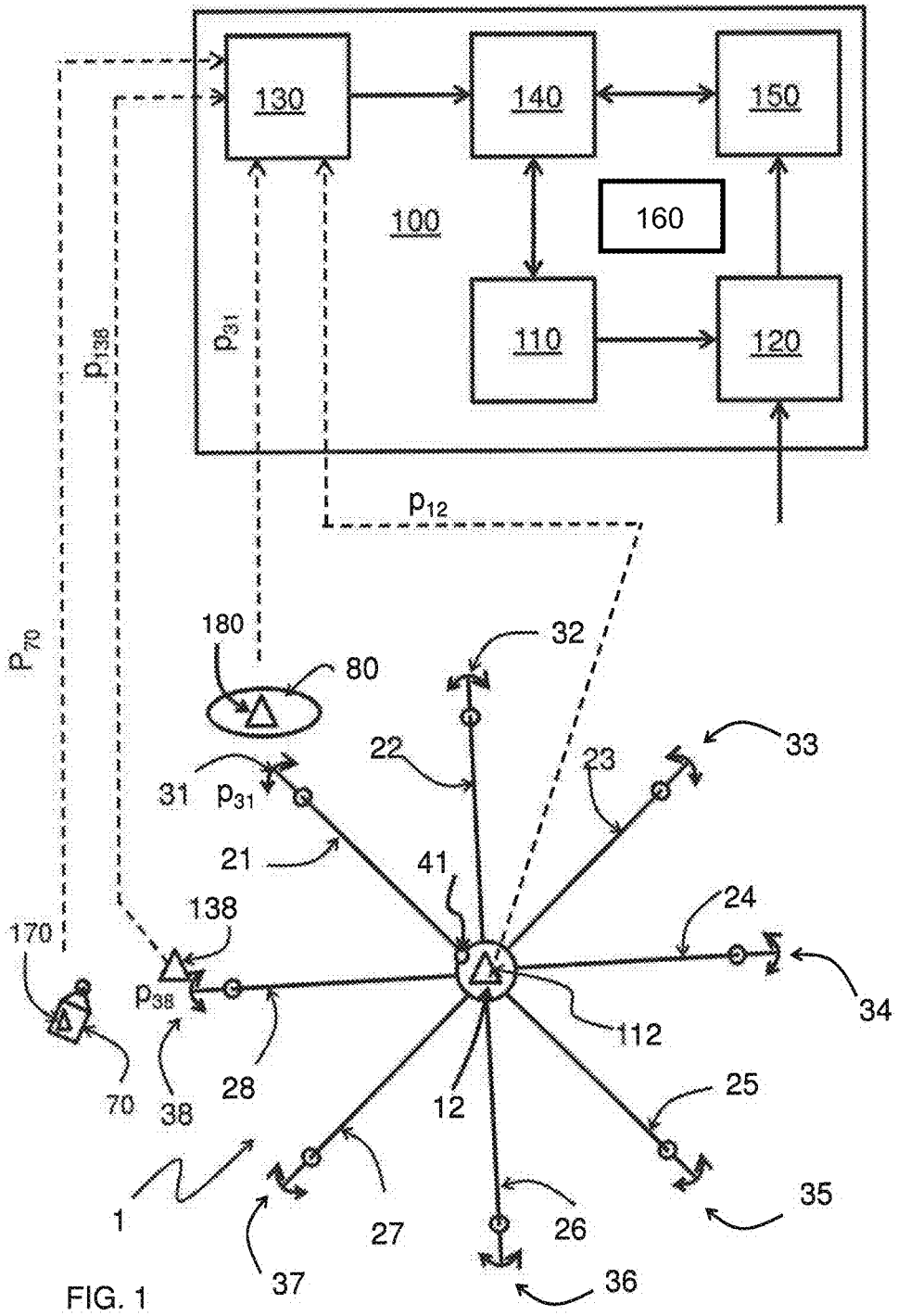
FIG. 1 schematically illustrates an embodiment of an offshore construction and a monitoring system for monitoring the same, FIGS. 2A, 2B schematically show how the coordinates and dimensions of the warning zone are related to the position of certain components of the offshore construction, therein

FIG. 1 schematically shows a monitoring system 100 for monitoring an offshore construction 1. The offshore construction 1 comprises mutually mechanically coupled marine assets. In the embodiment shown, the offshore construction 1 comprises a platform 12, stabilized by a plurality of anchoring elements 31, . . . , 38. The anchoring elements 31, . . . , 38. are mechanically coupled to the platform by respective mooring lines 21, . . . , 28. At the side of the platform the mooring lines 21, . . . , 28 are coupled to the platform via a fairlead, e.g. 41.

The monitoring system 100 for monitoring the offshore construction 1 comprises a data storage unit 110, an intrusion detection service 120, an input device 130, an update service 140, and a processor 160. The processor configured to operate (e.g., process, configure, receive/transmit data, etc.) the different services. The data storage unit 110 is provided for storing data specifying a spatial range of at least one warning zone pertaining to the offshore construction. A warning zone is understood to be zone having a spatial range associated with a marine asset to be protected. In practice a plurality of warning zones may be specified each for a particular marine asset to be protected. The data storage unit 110 is typically of a non-volatile type, e.g. a hard disk or a collection of hard disks. The data storage unit may have multiple components. These may be geographically spread. The intrusion detection service 120 is configured for detecting an intrusion of the spatial range of a warning zone, and for issuing an alert message upon such detection, for example signaling to a user interface 150. The alert message may be issued as an audio message, or as a visual message, e.g. by highlighting or a flashing effect on a display. The input device 130 is provided for receiving position information for one or more of the marine assets. Input may be provided by various sources, as is set out in the sequel. The update service 140 updates the spatial range of the warning zone based on said received position information.

Figure 2A:
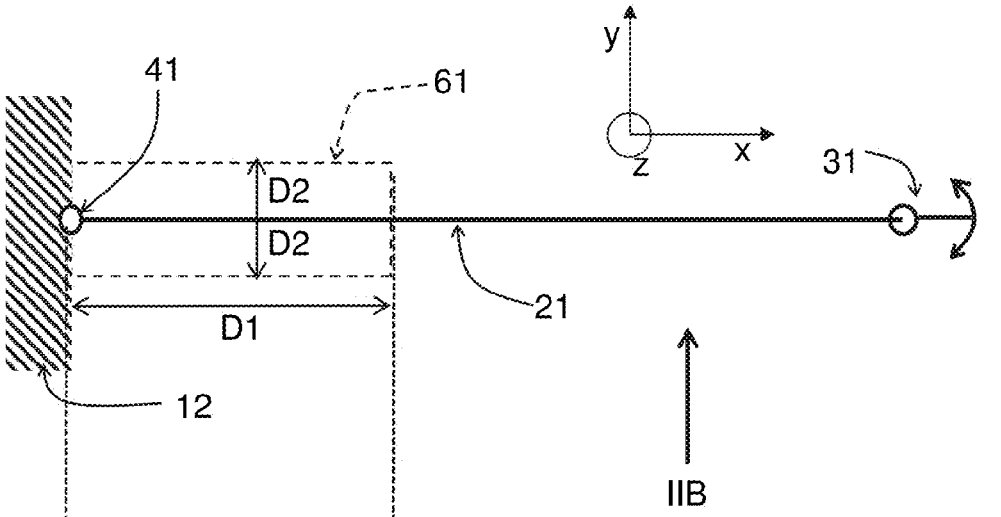
FIG. 2A shows a top view of these components and the associated warning zone.
Figure 2B:
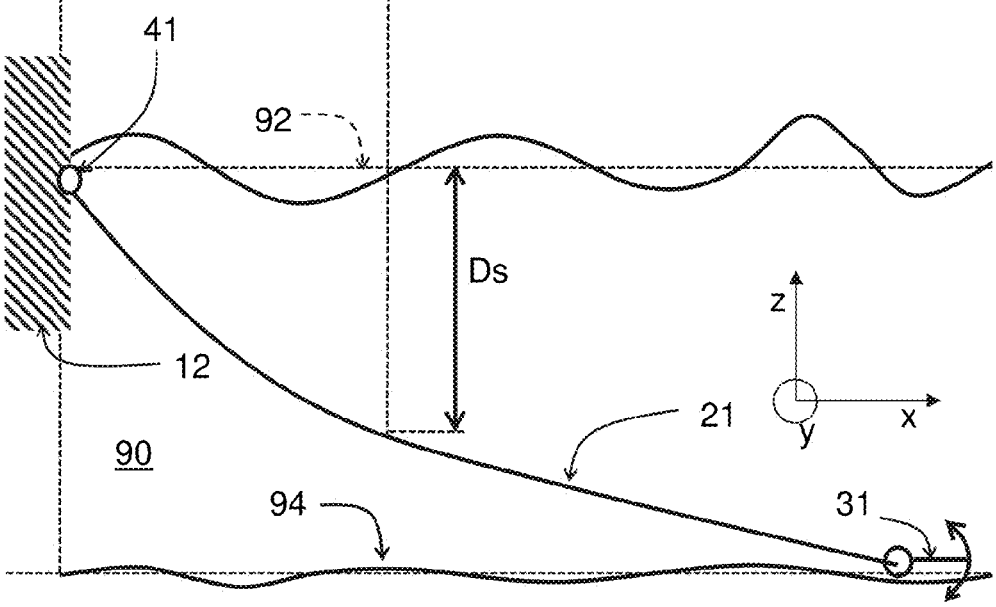
FIG. 2B shows a side view according to IIB in FIG. 2A, FIG. 3A schematically illustrates a graphical representation of an offshore construction and warning zones associated therewith.

FIGS. 2A and 2B schematically show how the coordinates and dimensions of a warning zone are related to the position of certain components of the offshore construction. Therein FIG. 2A shows a top view of these components and the associated warning zone. FIG. 2B shows a side view according to IIB in FIG. 2A.

FIG. 2A, 2B schematically show how a platform 12, e.g. a rig is connected via a mooring line 21 to an anchoring element 61 laying on the seabed 94. It is noted that the wording "line" or "mooring line" is used in a general sense. I.e. it is used to indicate any suitable elongate, flexible means for connecting the platform 12 to the anchoring element 31, such as a rope, a cable or a chain or the like, or a combination of two or more of such means that are mutually coupled. As show in FIG. 2B, the mooring line 21 extends from a position near the surface 92 of the sea 90, where it is connected to the platform 12, to a position on the seabed 94, where it is connected to the anchoring element 31. Particularly the first end of the mooring line 21 is vulnerable to collisions with bypassing vessels, as this first part is still close e.g. at a distance less than Ds, to the sea surface 92. It is presumed that there is no risk of collision for the second end of the cable having a distance of at least Ds to the sea surface 92. According to an embodiment of the present invention, the operator specifies a spatial range of a warning zone 61 associated with the mooring line 21. Intrusion by a vessel or other object of this spatial range is considered to imply the risk that the vessel or other object collides with the mooring line 21.

Figure 7:
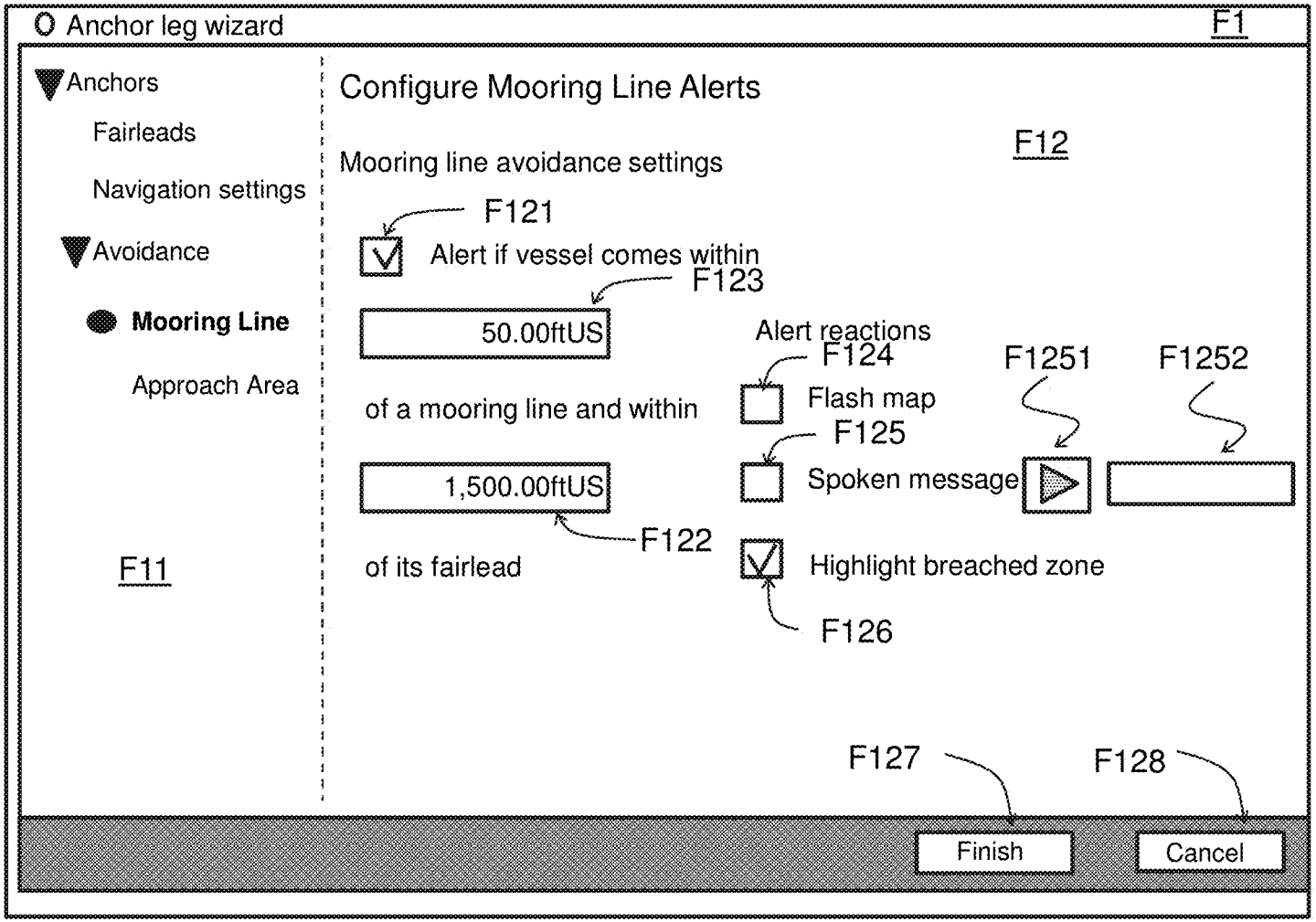
FIG. 7 shows a first instance of a graphical user interface instance, wherein an operator can specify a first type of warning zone.

In order to avoid this risk, the operator defines dimensions D1, D2 of a spatial range of the warning zone, for example with user interface 150, using the entry form as shown in FIG. 7. The operator specifies a rectangular spatial range, that is symmetrically arranged with respect to a mooring line 21 and that extends with its longest side along the mooring line from its connection point 41 with the platform 12. Therein the operator specifies D1 as the dimension of this longest side. This distance D1 is the distance beyond which it can be presumed that the mooring line is at a sufficient depth. The operator further specifies D2 as the distance that a vessel should keep with respect to the mooring line 21 when it is within the range of D1 with respect to the connection point 41.

Figure 3A:
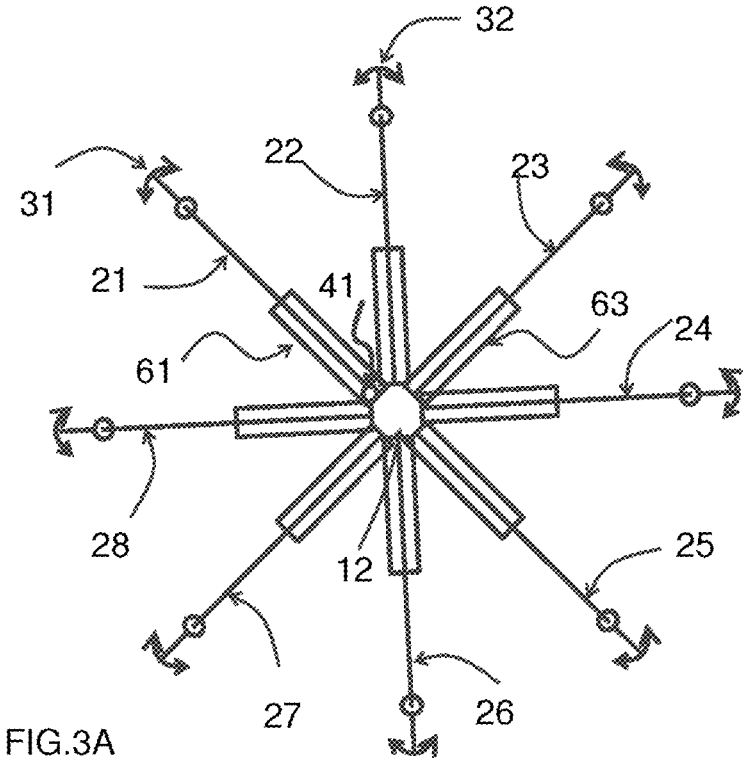
FIG. 3B shows an exemplary implementation of the graphical representation on a graphical user interface, FIG. 4A schematically illustrates a graphical representation of an offshore construction after it is displaced and warning zones associated therewith.
Figure 3B:
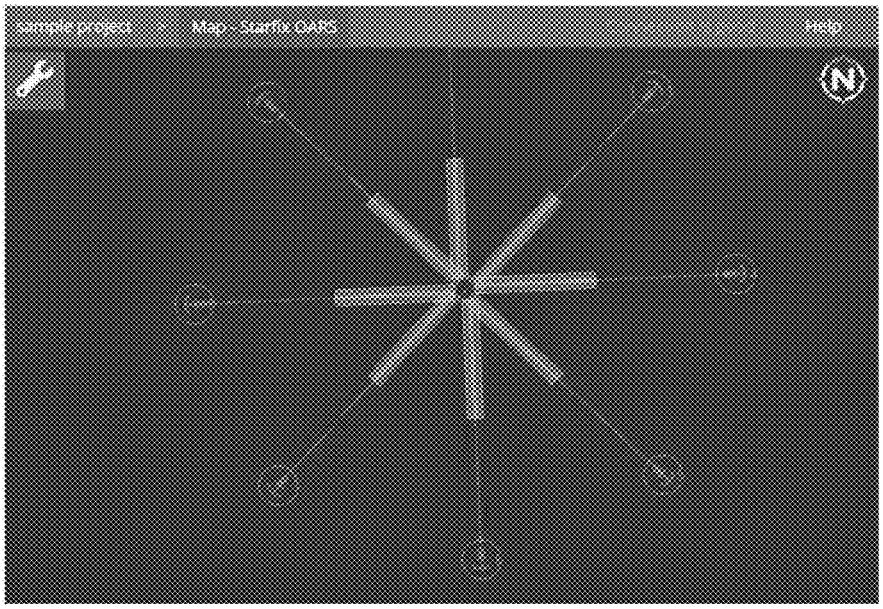

FIG. 3A schematically illustrates a graphical representation of an offshore construction and warning zones associated therewith. The graphical representation may be shown on a display, for example a display of user interface 150, for example as shown in FIG. 3B.

The graphical representation schematically shows a top-view of the offshore construction comprising the platform 12 as well as the mooring lines 21-28 connecting it to the anchoring elements 31-38. The graphical representation further shows the warning zones e.g. 61, 63, associated with the mooring lines.

Figure 4A:
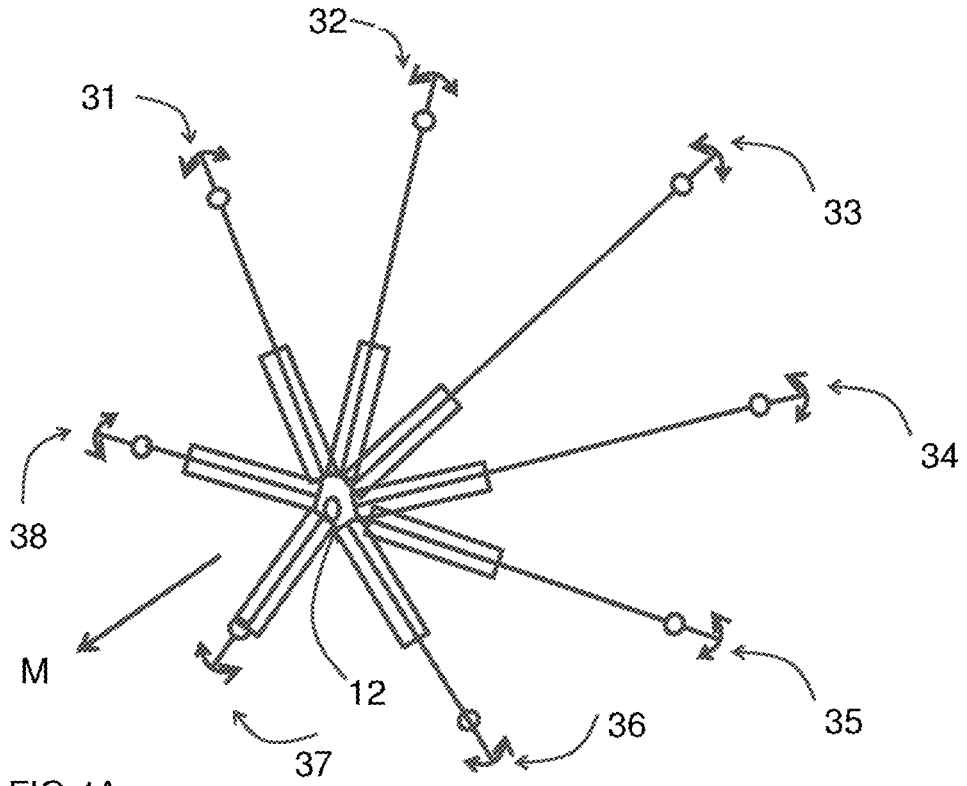
FIG. 4B shows an exemplary implementation of the graphical representation on a graphical user interface, FIG. 5A schematically illustrates a graphical representation of an offshore construction and its associated warning zones, and further illustrates how an operator may be alerted about intrusion of a warning zone by a vessel.
Figure 4B:
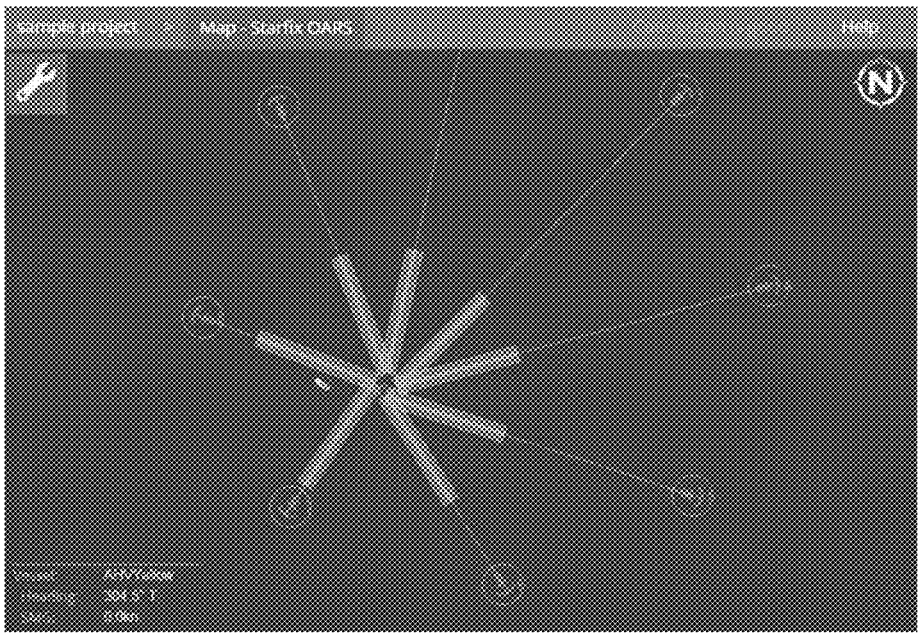

As illustrated in FIG. 4A, 4B, displacements of the platform 12 may occur. The platform may be displaced with or without changing the position of its anchors. FIG. 4A shows the latter situation, wherein the platform 12 is displaced over a distance M by paying out the mooring lines on one side and pulling in the mooring lines on the opposite side. The monitoring system 100 automatically adapts the spatial ranges of the warning zones in that it receives with input device 130 information $p_{12}$ about the coordinates of the platform 12 from a position estimation means 112, e.g. a GNSS position device and uses update service 140 to update the coordinates of the spatial ranges. In particular, input device 130 receives information about a position of at least one anchor fairlead 41 where an anchor mooring line 21 is coupled to the platform. In an embodiment, the monitoring system may include a single position and orientation estimation device that estimates the position and orientation of the platform, and that further uses the information about the dimensions of the platform to determine the position of the fairleads. Alternatively separate position sensor elements may be used for each of the fairleads, to determine their position.

Using the updated values for the coordinates $(x_{41},y_{41})$ of the position of the fairlead, the coordinates $(x_{31},y_{31})$ of the position of the anchor element 31 and the dimensions D1 and D2 specified by the operator the update service calculates the spatial range as the rectangular area having a pair of short sides and a pair of long sides, which has one of its short sides centered on the fair lead, and which extends symmetrically with respect to the mooring line 21 in the direction of the anchoring element 31.

There with the spatial range of the warning zone is kept consistent with the positions of the marine assets without needing separate input from the operator.

Figure 5A:
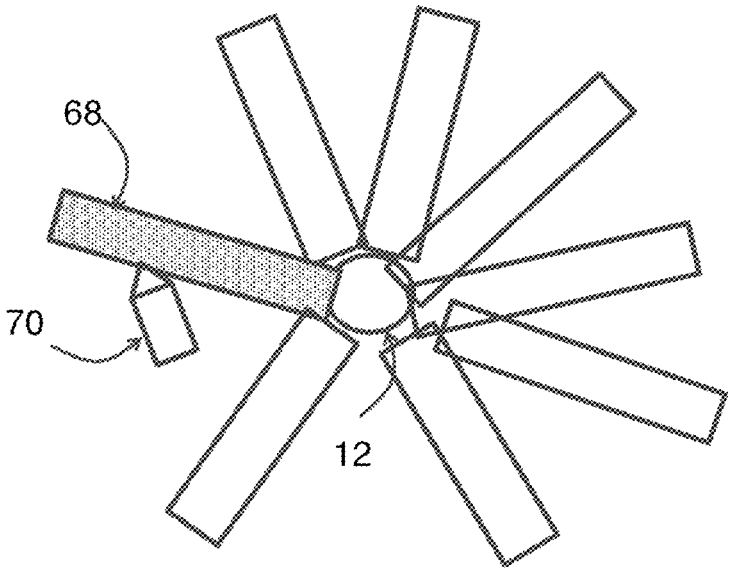
FIG. 5B shows an exemplary implementation of this graphical representation on a graphical user interface, FIG. 6A schematically illustrates a graphical representation of an offshore construction as well as warning zones of a second type associated therewith.

FIG. 5A schematically illustrates a graphical representation of an offshore construction and its associated warning zones, and further illustrates how an operator may be alerted about intrusion of a warning zone by a vessel 70.

In the example shown, a warning zone 68 is intruded by a vessel 70. The operator is alarmed by highlighting this warning zone, as is shown by way of example on a graphical user interface in FIG. 5B. Alternatively, the operator may be alarmed in case of occurrence of such an event by a causing a blinking effect, for example a blinking effect of the warning zone or even a blinking effect of the entire screen. Also audio messages may be given. A warning zone may be associated with nested spatial ranges, wherein an escalation of warning signals follows in case a vessel approaches the inner spatial range. For example a warning zone may be highlighted if the vessel enters the outer spatial range, the screen may start flashing if the vessel enters a middle one of the spatial ranges and an audio message may be issued if the vessel enters the most inner one of the spatial ranges.

Figure 6A:
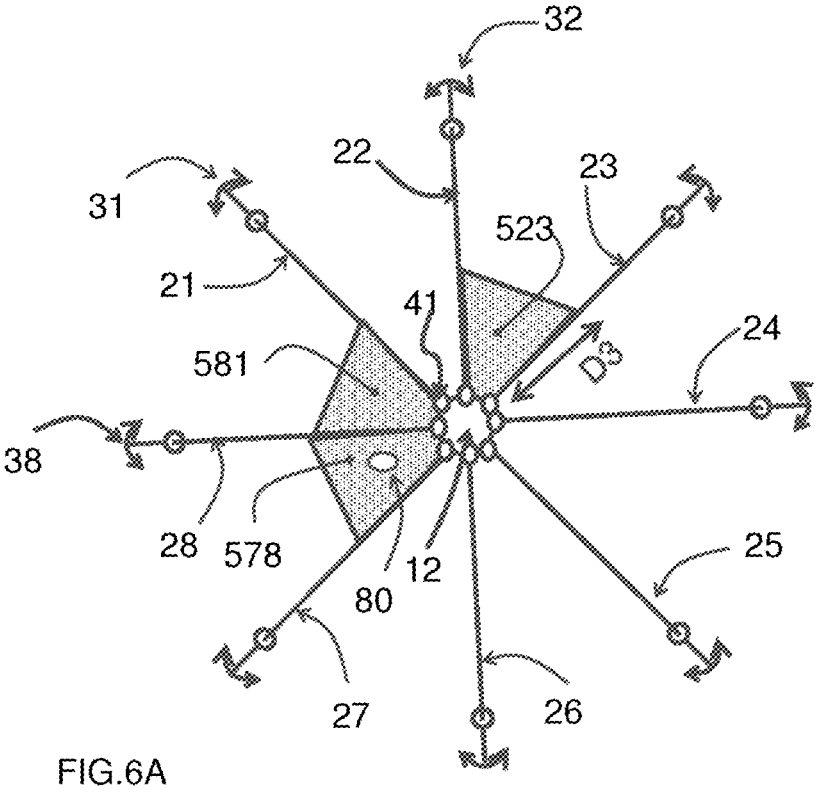
FIG. 6B shows an exemplary implementation of this graphical representation on a graphical user interface.
Figure 6B:
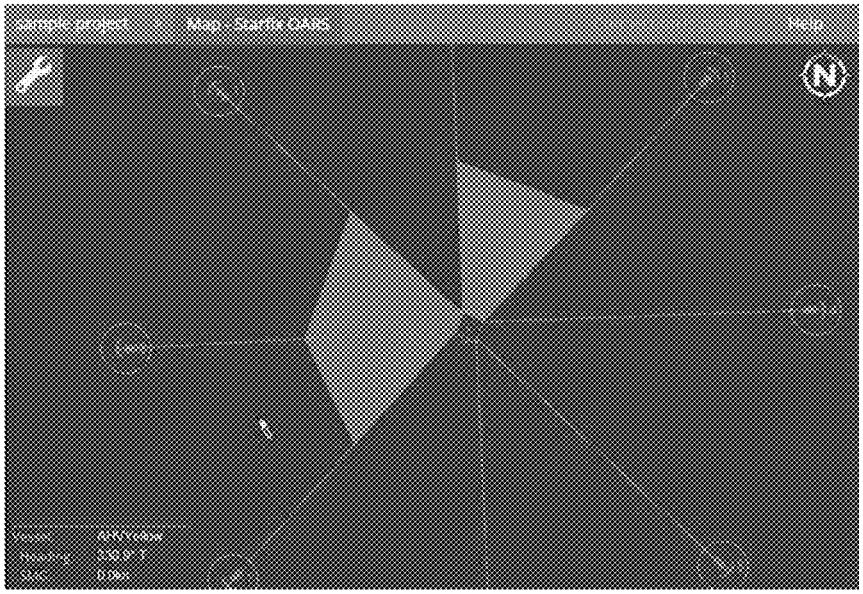

FIG. 6A schematically illustrates a second type of warning zone to be used for protecting an offshore construction, FIG. 6B shows an exemplary implementation of this graphical representation on a graphical user interface.

This type of warning zone e.g. warning zone 581 has a spatial range bounded between a first and a second mutually subsequent mooring line here mooring lines 28 and 21. Also two other warning zones 523 and 578 of this type are shown.

Figure 8:
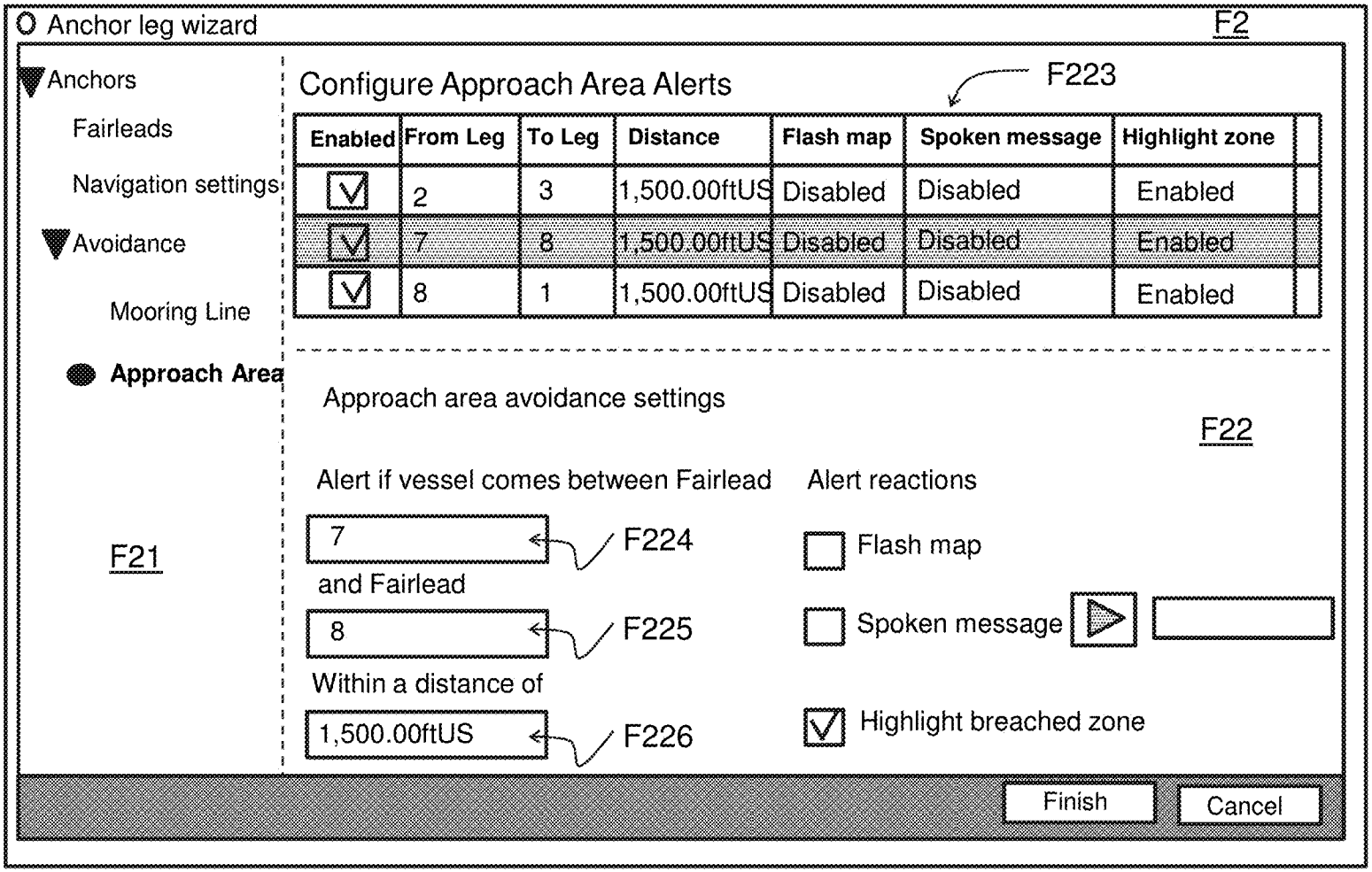
FIG. 8 shows a second instance of a graphical user interface instance, wherein an operator can specify a second type of warning zone.

In the embodiment shown the spatial range is further bounded by a boundary extending from a position on the first mooring line 28 to a position on the second mooring line 21. The further boundary element may for example be a straight line or an arc. In this case the operator may specify the mooring lines, e.g. 28 and 21 that define the warning zone, and a distance D3 to be kept. FIG. 8 shows an exemplary instance of a user interface with which the operator can set these parameters.

The spatial range for this warning zone may be approximated as a polygon that extends between a first point defined by the position of the fairlead of the first mooring line (e.g. 27) to a second point, coinciding with a position on that mooring line at a distance D3 from its fairlead, to a third point coinciding with a position on a second mooring line (e.g. 28) to a fourth point coinciding with the fairlead of that second mooring line and back to the first point.

Based on input received about the actual positions of the anchoring elements, here 27 and 28, and the positions of the fairleads of the mooring lines coupling these anchors with the platform 12.

Figure 5B:
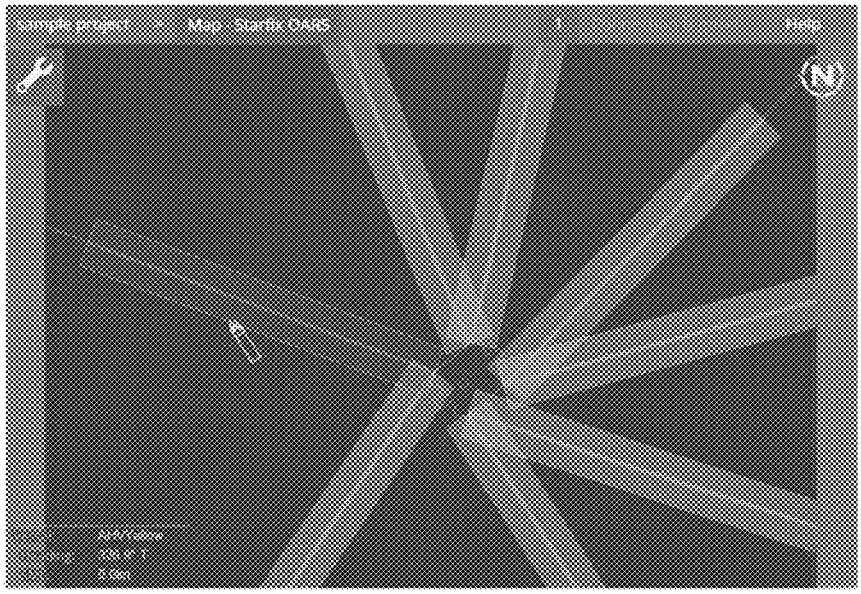

Upon intrusion of these warning zones an alarm may be issued in the same manner as discussed with reference to FIG. 5A, 5B.

FIG. 9A to 9F illustrate an operation wherein an anchoring element 38 is displaced using a vessel 70.

Figure 9A:
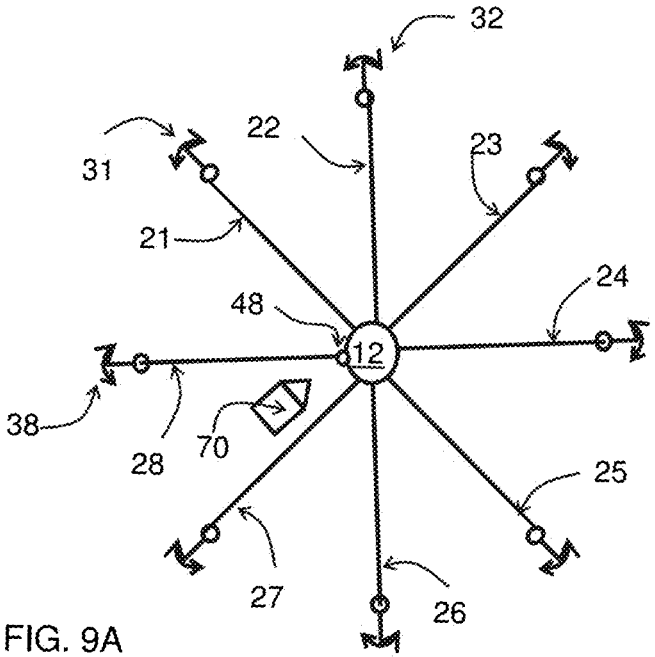
FIG. 9A to 9F shows various stages of a displacement operation.
Figure 9B:
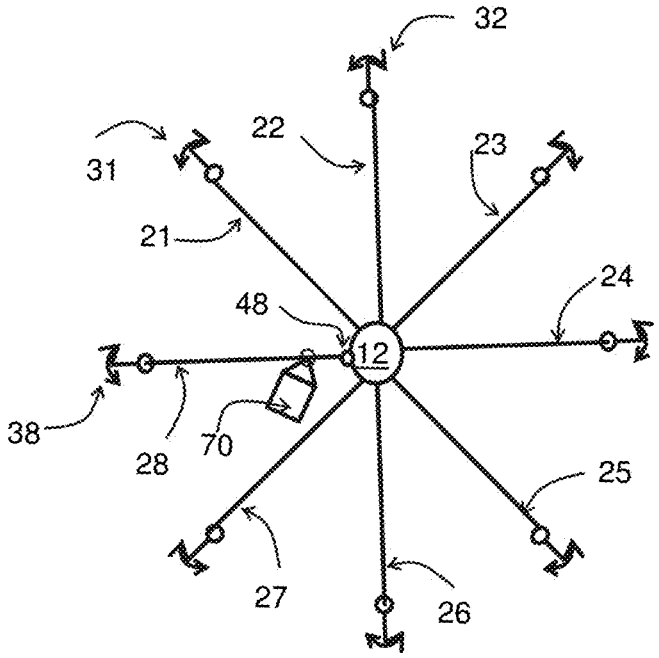
Figure 9C:
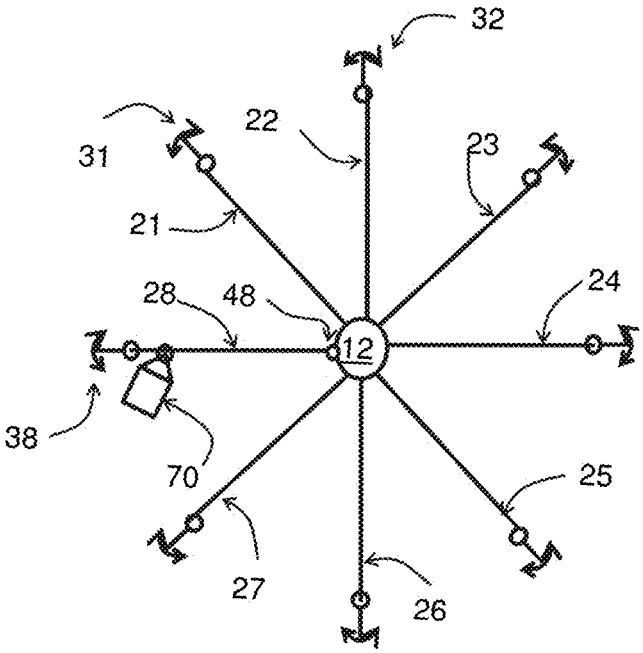
Figure 9D:
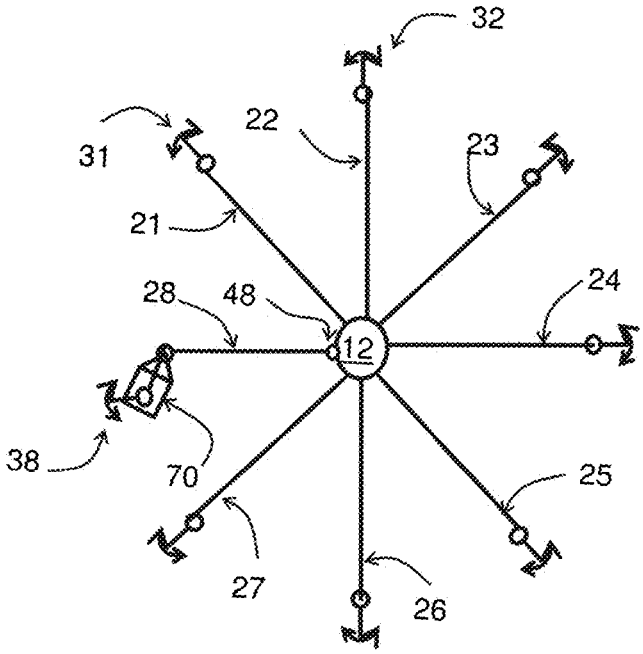
Figure 9E:
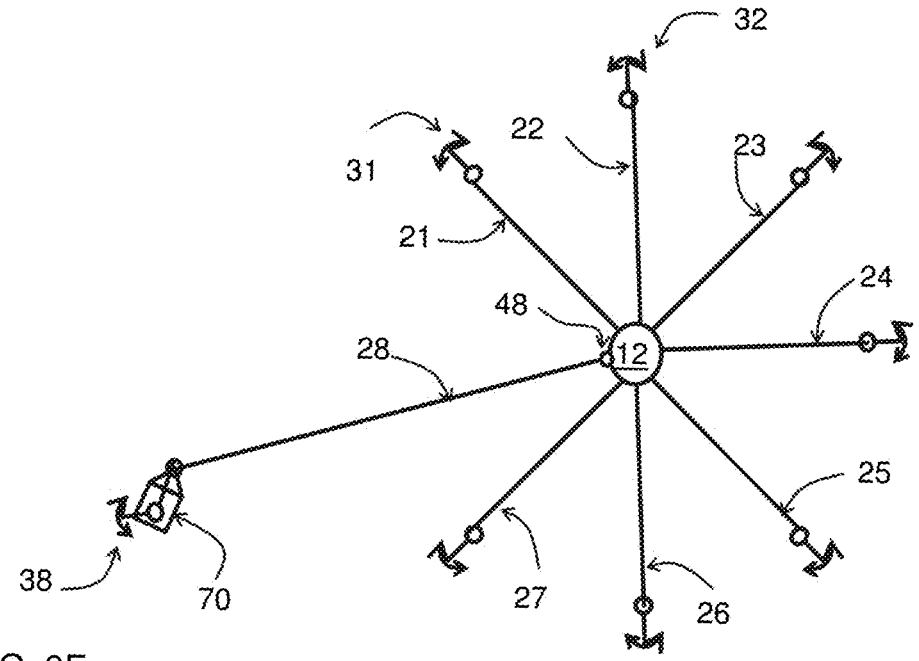
Figure 9F:
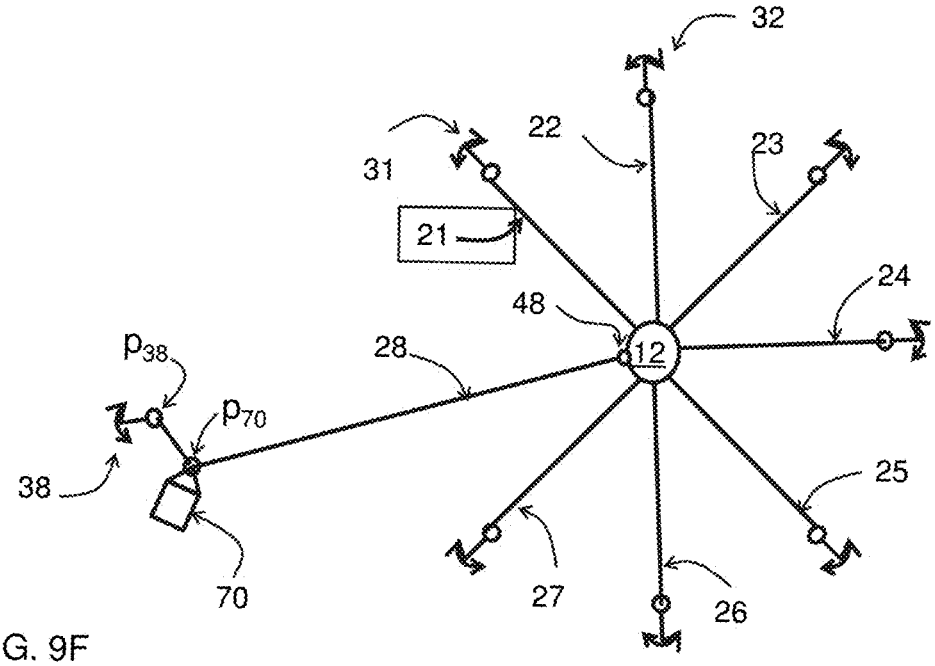

FIG. 9A shows how the vessel 70 approaches the platform. In FIG. 9B, it picks up a mooring line 28 connected with an anchoring element 38. As illustrated in FIG. 9C the vessel heads toward the anchoring element 38, so that it can lift the anchoring element from its current position on the seabed onto the vessel (FIG. 9D), so as to \ and transport it to another position as shown in FIG. 9E. At that position it moors the anchoring element 38 allowing it to sink to the seabed. The coordinates $(x_{70},y_{70})$ of the position of the vessel can be used to estimate the new position of the anchoring element. To that end the vessel transmits (signal carrying information $p_{70}$) its position to the input device of the monitoring system. The update service 140 may subsequently update the position of the anchoring element 38, by estimating its position as the position where it was moored, i.e. the coordinates $(x_{70},y_{70})$ of the position of the vessel at the time of mooring. Alternatively, the mooring position of the anchoring element may be determined by an estimation using the coordinates $(x_{70},y_{70})$ of the position of the vessel at the time of mooring, while taking into account an estimated drift of said anchoring element while mooring to the seabed. This more accurate estimation may be carried out by an estimation service on board of the vessel 70, in which case the result of this estimation is transmitted to the input device 130. Alternatively the calculation for this more accurate estimation may be carried out by a calculation service incorporated in the monitoring system 100.

Having obtained the new coordinates of the anchoring element 38, the update service can update the spatial ranges defined for the warning zones to be observed for the offshore construction.

Other sources are possible to update the provide position information to be received by input device 130 used to update the relevant spatial ranges. Examples thereof are shown in FIG. 1. As discussed above, position determining devices may be attached to a marine asset so as to determine its position and it may transmit the position so determined to the input device 130. By way of example FIG. 1 shows an embodiment wherein an anchor position determining device 138 (also denoted as anchor position estimation device) is attached to an anchor 38. In operation it transmits a signal p138 indicating the estimated position of the anchor 38. Such a position determining device may operate in various ways. For example it may periodically transmit the determined position to the input device. Alternatively, the input device may poll a position determining e.g. 138 device to provide the coordinates of the asset to which it is attached upon request. In again another embodiment the position determining device may be configured to determine a position of the asset to which it is attached when it detects a movement of the latter. For example the position determining device may have a trigger service and a GNSS position service. The GNSS position service may be kept in a dormant mode until it is triggered by the trigger service. The latter may for example include an acceleration detector, and trigger the GNSS position service if it detects an acceleration. The position determining device may transmit the position it determines together with a time stamp indicating the point in time it transferred the position. Alternatively the input device 130 may associate information received from a position determining device with a time stamp.

In the example shown in FIG. 1 a position determining device 112 is attached to the platform 12. The position determining device 112 additionally determines the orientation of the platform. Therewith, knowing how the fairleads are arranged on the platform, the position of the fairleads can also be determined. FIG. 1 further shows a position determining device 180 mounted on an under-water vehicle 80, for example an autonomous or remotely operated under-water vehicle. The under-water vehicle 80 may carry out a periodical surveillance course along the marine assets and the position determining device 180 may transmit the positions of the marine assets visited by the under-water vehicle 80 to the input device 130, so that the update service can use the position information to keep the spatial ranges of the warning zones up to date. In the example shown the position determining device 180 of the under-water vehicle 80 transmits position information p31, concerning the position of the anchoring element 31 to the input device 130. Even though in this specific example the position is transmitted by a position determining device 180, this is not an essential feature since, in general, any position updates derived by the software or input by any means to the input device 130 could be used to update the spatial ranges of the warning zones.

FIG. 7 schematically shows a user form F1 to be presented on a graphical user interface for allowing an operator to specify dimensions of a first type of warning zones to be observed. In the leftmost part F11 of this form it can be seen that the operator has selected the option Anchors.Avoidance.Mooring Line. This is the form wherein the operator can specifically set the dimensions D1, D2 of the warning zones associated with the mooring lines. In the rightmost part F12 the operator can enter the specific settings. Upon activation by tick box F121, the user can specify the dimension D1 (See FIG. 2A) of the rectangular area in field F122, and the dimension D2 in field F123. The operator can further specify which type of alert should be given. Tick box F124 serves to select a flashing effect as the alert signal, tick box F125 is for selecting an audible alert message, and tick box F126, selected here, is for providing the alert by highlighting the breached zone. In case the operator selects box F125, subsequently an audible message may be recorded using button F1251, or a message may be typed into box F1252, which in the case of a detected intrusion is uttered by a speech synthesis service. It is noted that two or more alert types may be combined. It may be considered to deselect all alerts. In that case the operator may still be aware of an intrusion. For example the operator observing the screen of FIG. 5A, 5B would still notice that warning zone 68 is intruded, even if the warning zone is not highlighted. For optimal safety, it is however preferred that at least one type of alert message is given upon intrusion. Having entered the specifications the operator can save and apply the settings by the button F127. Alternatively, the operator can cancel the settings with button F128. In both cases the operator exits the form.

FIG. 8 schematically shows a user form F2 to be presented on a graphical user interface for allowing an operator to specify dimensions of a second type of warning zones to be observed. This is the type of warning zone as shown in and described with reference to FIG. 6A, 6B. In the leftmost part F21 of this form it can be seen that the operator has selected the option Anchors.Avoidance.Approach Area. This allows the operator can specifically set the warning zones bounded by a pair of mooring lines. In the rightmost part F22 the operator can enter the specific settings. The table F223 on top shows an overview of the current settings. In the leftmost column it confirms the enabled warning zones. The second and the third column specify for each warning zone the pair of mooring lines by which it is bounded. For example the first warning zone, as defined in the first line below the header pertains to the warning zone 523 (See FIG. 6A) between mooring lines 22 and 23 denoted simply by 2 and 3 in the table F223. The fourth column shows the distance to the platform 12 that should be maintained, this is the distance D3 in FIG. 6A. The fifth column shows whether a first type of alert message (Flash map) is enabled, the sixth column shows whether a second type of alert message (spoken message) is enabled, and the seventh column shows whether a third type of alert message (Highlight zone) is enabled. In the example shown the third type of alert message is enable for the three warning zones specified in the table. The other types of alert messages are currently disabled. It is noted that different warning zones may have different alert types. The operator may modify settings by selecting a row in the table. Also the operator may add new warning zones, for example by pointing to a position just below the table. In this case the operator has selected the second row below the header, which corresponds to the warning zone 578 in FIG. 6A. In fields F224, F225 and F226 the operator can now modify or set the specifications, by entering numbers for the mooring lines (legs) into fields F224 and F225 and by setting the distance D3 in field F226. In a manner analogous as described with reference to FIG. 7, the operator can set or modify the alert reactions to be issued upon a detection of intrusion. Similarly, in a manner analogous as described with reference to FIG. 7, the operator can exit the form with or without saving the settings.

The warning zones, e.g. 581 and 523 as shown in FIG. 6A, 6B are particularly suitable for protection of marine assets other than the mooring lines associated with the platform 12. FIG. 6A, 6B further show an example of a warning zone 578 that is assigned to an under-water vehicle 80. Such an under-water vehicle 80 may be employed to perform measurements and inspections in the neighborhood of the platform. In this case a warning zone like 578 may be defined in the user form F2 of FIG. 8 to avoid that the under-water vehicle is damaged by passing vessels.

Figure 10:
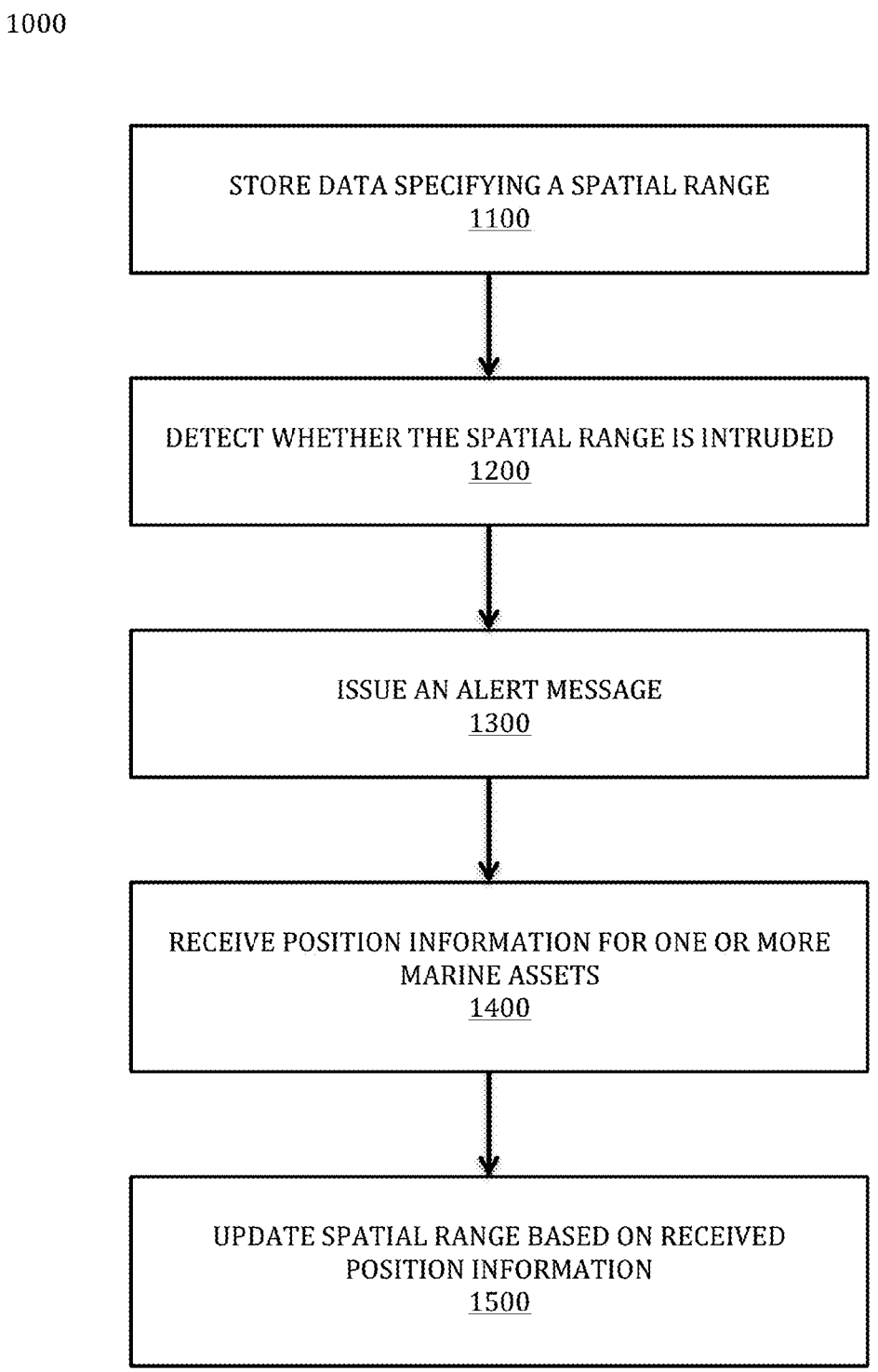
FIG. 10 shows an example method of monitoring offshore construction.

FIG. 10 shows an example method 1000 for monitoring offshore construction. The method can begin at block 1100. At block 1100, a processor can store data specifying a spatial range of at least one warning zone pertaining to the offshore construction. At block 1200, the processor can detect whether the spatial range is intruded. At block 1300, in response to a detection of the intrusion an alert message can be issued by the processor. At block 1400, the processor, via an input device, can receive position information for one or more marine assets. At block 1500, the processor can update the spatial range based on the received position information.

Method 1000 can further include: displacing an anchoring element of a plurality of anchoring elements with a vessel, mooring the anchoring element by the vessel, determining a mooring position of the anchoring element, and updating the spatial range of the at least one warning zone using the determined mooring position of the anchoring element.

In some examples, instructions for executing method 1000 can be stored on a non-transitory memory. The instructions executable by the processor.

It is noted that the computational resources of the monitoring system may be integrated. Alternatively, these resources may be geographically spread and communicatively coupled. For example the system may include a central server that is arranged onshore, and that communicates with clients involved in the offshore operations. Alternatively, individual marine assets may have proper computation facilities that participate in the monitoring system. For example a vessel used to moor an anchoring element may have computation facilities to estimate the position where the anchor lands on the seabed. Computational resources may be provided as dedicated hardware, as generally programmable devices having a dedicated control simulation program, as dedicated programmable hardware having a dedicated program, or combinations thereof. Also configurable devices may be used, such as FPGA's.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

While the present invention has been described with respect to a limited number of embodiments, those skilled in the art will appreciate numerous modifications and variations therefrom within the scope of this present invention as determined by the appended claims.

We claim:

1. A monitoring system for monitoring an offshore construction, the offshore construction comprising mutually mechanically coupled marine assets, the monitoring system comprising:

a platform stabilized by the marine assets comprising at least a plurality of anchoring elements that are mechanically coupled to the platform by respective mooring lines;

a data storage unit configured to store data specifying a spatial range of at least one warning zone pertaining to the offshore construction;

a processor, the processor configured to detect an intrusion of the spatial range and for issuing an alert message upon such detection;

an input device for receiving position information for one or more of the marine assets, wherein the received position information pertains to at least one anchoring element of the plurality of anchoring elements; and the processor configured to update the spatial range of the at least one warning zone associated with a mooring line that mechanically connects the at least one anchoring element with the platform based on the received position information.

2. The monitoring system according to claim 1, wherein the position information pertains to an anchoring element of the plurality of anchoring elements, and wherein the processor is configured to update a spatial range of a warning zone extending between a mooring line that mechanically connects the platform with the anchoring element and a further mooring line that mechanically couples the platform with a further anchoring element.

3. The monitoring system according to claim 1, further including a vessel position determining device to be carried by a vessel used to moor an anchoring element at a point in time and communicatively coupled with the input device to transmit information pertaining to a position of the vessel to the input device, wherein the processor is configured to derive the position information of the anchoring element from the information pertaining to a position of the vessel at the point in time.

4. The monitoring system according to claim 3, wherein the processor is configured to derive the position information of the anchoring element by approximating the position of the anchoring element as the position of the vessel at the time of mooring as indicated by the information pertaining to a position of the vessel.

5. The monitoring system according to claim 3, wherein the processor is configured to derive the position information of the anchoring element from the position of the vessel at the time of mooring as indicated by the information pertaining to a position of the vessel, further taking into account an estimated drift of the anchoring element while mooring to the seabed.

6. The monitoring system according to claim 1, further comprising an anchor position estimation device to be carried by an anchoring element, and communicatively coupled to the input device to transmit information pertaining to a position of the anchoring element.

7. The monitoring system according to claim 1, further comprising an anchor position estimation device incorporated into an Remotely Operated Vehicle or an Autonomous Under-water Vehicles communicatively coupled to the input device to transmit information pertaining to a position of the anchoring element.

8. The monitoring system according to claim 1, further comprising a platform position estimation device communicatively coupled to the input device to transmit information pertaining to a position of the platform.

9. The monitoring system according to claim 8, wherein the information pertaining to a position of the platform is information pertaining to a position of at least one anchor fairlead where an anchor mooring line is coupled to the platform.

10. The monitoring system according to claim 1, wherein the warning zone has a rectangular spatial range, that is symmetrically arranged with respect to a mooring line and that extends with its longest side along the mooring line from its connection point with the platform.

11. The monitoring system according to claim 1, wherein the warning zone has a spatial range bounded between a first and a second mutually subsequent mooring line.

12. The monitoring system according to claim 11, wherein the spatial range is further bounded by a boundary extending from a position on the first mooring line to a position on the second mooring line.

13. The monitoring system according to claim 1, further comprising a graphical user interface for enabling an operator to specify spatial dimensions of the spatial range and or for graphically representing the warning zones applicable to the offshore construction and or for graphically representing an intrusion of a warning zone by an object.

14. A method for monitoring an offshore construction, the offshore construction comprising mutually mechanically coupled marine assets, the method comprising:

storing, by a processor at a data storage unit, data specifying a spatial range of at least one warning zone pertaining to the offshore construction;

detecting, by the processor, whether the spatial range is intruded;

upon detection of intrusion issuing, by the processor, an alert message;

receiving, at an input device, position information for one or more of the marine assets, wherein the received position information pertains to the marine assets comprising at least one anchoring element of a plurality of anchoring elements that are mechanically coupled to a platform by respective mooring lines; and updating, by the processor, the spatial range of the at least one warning zone associated with a mooring line that mechanically connects the at least one anchoring element with the platform based on the received position information.

15. The method according to claim 14, further comprising:

displacing an anchoring element of the plurality of anchoring elements with a vessel;

mooring the anchoring element by the vessel;

determining a mooring position of the anchoring element;

updating the spatial range of the at least one warning zone using the determined mooring position of the anchoring element.

16. The method according to claim 15, wherein the mooring position of the anchoring element is determined by approximating the mooring as the position of the vessel at the time of mooring.

17. The method according to claim 15, wherein the mooring position of the anchoring element is determined by an estimation using the position of the vessel at the time of mooring, while taking into account an estimated drift of the anchoring element while mooring to the seabed.

18. The method of claim 14, further comprising assigning a warning zone with a spatial range to an under-water vehicle.

19. A non-transitory computer readable medium storing instructions, which when executed by a processor, cause the processor to:

store at a data storage unit, data specifying a spatial range of at least one warning zone pertaining to the offshore construction;

detect whether the spatial range is intruded;

upon detection of intrusion issue an alert message;

receive position information for one or more of the marine assets, wherein the received position information pertains to the marine assets comprising at least one anchoring element of a plurality of anchoring elements that are mechanically coupled to a platform by respective mooring lines; and update the spatial range of the at least one warning zone associated with a mooring line that mechanically connects the at least one anchoring element with the platform based on the received position information.

20. The computer readable medium of claim 19, comprising further instructions which when executed by the processor causes the processor to:

displace an anchoring element of the plurality of anchoring elements with a vessel;

moor the anchoring element by the vessel;

determine a mooring position of the anchoring element;

update the spatial range of the at least one warning zone using the determined mooring position of the anchoring element.

* * * * *